US009927215B2

(12) United States Patent
Harris et al.

(10) Patent No.: US 9,927,215 B2
(45) Date of Patent: Mar. 27, 2018

(54) TARGET SYSTEM

(71) Applicant: 4 Beards Holdings, LLC, St. Louis, MO (US)

(72) Inventors: Kenneth Harris, St. Louis, MO (US); Aaron Brookhart, St. Louis, MO (US); Brandon Hefer, St. Louis, MO (US); Justin Snell, St. Louis, MO (US)

(73) Assignee: TS Founders, LLC, St. Louis, MO (US)

( * ) Notice: Subject to any disclaimer, the term of this patent is extended or adjusted under 35 U.S.C. 154(b) by 0 days.

(21) Appl. No.: 14/808,748

(22) Filed: Jul. 24, 2015

(65) Prior Publication Data

US 2016/0054104 A1 Feb. 25, 2016

Related U.S. Application Data

(60) Provisional application No. 62/028,318, filed on Jul. 24, 2014.

(51) Int. Cl.

| | |
|---|---|
| ***A63B 63/00*** | (2006.01) |
| ***F41J 9/00*** | (2006.01) |
| ***F41J 7/00*** | (2006.01) |
| ***F41J 1/10*** | (2006.01) |

(52) U.S. Cl.
CPC .. *F41J 7/00* (2013.01); *F41J 1/10* (2013.01)

(58) Field of Classification Search
CPC . F41J 7/00; F41J 1/10; F41J 1/01; F41J 9/00; F41J 9/02; F41J 7/04; A63B 63/06
USPC .... 273/368, 370, 359, 406, 390, 393, 348.1, 273/407, 409, 400, 369
See application file for complete search history.

(56) References Cited

U.S. PATENT DOCUMENTS

| | | | | |
|---|---|---|---|---|
| 3,914,879 | A | 10/1975 | Taylor, III et al. | |
| 4,288,080 | A | 9/1981 | Laporte | |
| 5,350,180 | A | 9/1994 | Acock | |
| 7,900,927 | B1 | 3/2011 | Bliehall | |
| 7,950,667 | B2 * | 5/2011 | Shum | F41J 7/06 273/406 |
| 8,444,150 | B1 * | 5/2013 | Stirtz | A63B 63/06 273/369 |
| 9,157,706 | B2 | 10/2015 | Shea | |
| 2008/0088089 | A1 * | 4/2008 | Bliehall | F41J 9/02 273/359 |
| 2011/0298181 | A1 * | 12/2011 | Wright | F41J 7/06 273/370 |

(Continued)

OTHER PUBLICATIONS

International Search Report, International Patent Application No. PCT/US2015/042092, dated Oct. 19, 2015, 8 pages.

(Continued)

*Primary Examiner* — Gene Kim
*Assistant Examiner* — Christopher Glenn
(74) *Attorney, Agent, or Firm* — Creativenture Law, LLC; Dennis JM Donahue, III

(57) ABSTRACT

A target system designed to be stand-alone and modular which includes a target area which is two or more sided and which can be rotated through a large number of different positions and rotations. The system can also include systems for projectile impact recognition. Target rotation is generally accomplished through a target base that is in communication with and configured to receive data input from a remote target controller.

20 Claims, 7 Drawing Sheets

(56) References Cited

U.S. PATENT DOCUMENTS

| | | | | |
|---|---|---|---|---|
| 2012/0218633 | A1* | 8/2012 | Cincotti | F41J 1/01 359/463 |
| 2012/0313324 | A1 | 12/2012 | Frickey | |
| 2013/0147117 | A1* | 6/2013 | Graham | F41J 5/04 273/393 |
| 2015/0233685 | A1* | 8/2015 | Dennison | F41J 9/02 273/369 |

OTHER PUBLICATIONS

"SPTARGETS—Wireless Control Unit Specifications," http://sptargets.com/wireless-control-unit-specifications, printed on Jul. 22, 2014, 4 pages.

* cited by examiner

TARGET SYSTEM

CROSS REFERENCE TO RELATED APPLICATIONS

This application claims benefit of U.S. Provisional Patent Application No. 62/028,318, filed Jul. 24, 2014, the entirety of which is incorporated herein by reference.

BACKGROUND

1. Field of the Invention

The present invention relates to a firearm target training device, a target system, and a method of using a target system.

2. Description of the Related Art

Target systems are used to improve shooting skills. Target systems are located predominantly on static shooting ranges, but can also be setup in arenas, simulators or "shooting houses" where a specially designed bunker can be used to present structure clearing and securing scenarios. Shooting ranges typically have indoor and outdoor shooting lanes where shooters will be provided with a lane and will shoot at a target positioned at the end of their lane while other shooters do the same in adjacent lanes. Most shooting practice at standard ranges (e.g. not at particularly long ranges) will utilize a paper target as this allows for a user to shoot at the target and then retrieve the target to both determine the accuracy of their shooting, and to keep records of their performance in a particular event or over time.

A shooting range typically offers a customer a variety of weapons and ammunition to use for shooting at the targets. Often, a customer will bring a personal weapon and ammunition for shooting. Because shooting ranges are generally built to accommodate many shooters at the same time using a variety of firearms, ammunition, loading systems, and clip sizes, the paper targets are typically fixed to a rail. The user will affix the target to the rail while standing in their shooting position and then activate the rail to carry the target downrange. This allows each shooter to operate according to their own timing, ammunition expenditure, etc. and replace targets without the need for the shooter to actually go downrange. Because no shooter ever goes downrange while at the range (unless there is a problem), there is no need for shooters to wait on each other to affix and use their targets. Instead, the downrange area is always clear of people and there is improved safety and efficiency. During the target shooting session, the shooter aims and fires at the downrange target. After the shooter expends a desired number of rounds, the shooter can return the target via the same rail and take down the target to see where the target was hit. They can then replace it with another target, if desired, and repeat.

The problem with current target systems found on shooting ranges is that they do not provide the shooter with an interactive and individualized shooting experience. The current target systems are built on platforms that prevent the shooter from engaging in many challenging and exciting shooting exercises where targets move because the targets are generally in fixed position due to the limitations of the transport rail and shooting lane. The fixed position of the targets prevents the shooter from improving skills for shooting at a moving target. As many forms of shooting skills (including those for, hunting, self-defense, policing, and military activities) involve ultimately training to shoot at a moving target, this limits the effectiveness of training a shooting range can offer.

For many types of shooting practice this is fine as necessary skills are still practiced. Static ranges allow one to improve one's aiming and dialing in of sights, handling of a firearm of a particular type, and comfort level with the gun's particular behavior (such as the level of recoil for different ammunition types) when it is fired. At the same time, however, static shooting targets can often not provide for any kind of simulated scenarios where the firearm may be used. These scenarios can range from self-defense training and concealed carry training for civilians to police and military hostage and combat situations which are inherently highly dynamic and variable. Further, there is also an enjoyment factor in participating in shooting scenarios even though they may likely never be encountered. For example, there is an entertainment value to getting to shoot "zombies" with an actual firearm in a simulated fantasy setting.

To try and create additional shooting scenarios for entertainment and training purposes, targets are often positioned inside shooting houses or other simulated buildings. These locations provide for what is essentially a specialized building or location that the shooter can move through where they can be presented with a variety of static and dynamic targets. Targets (which are often still paper but can also be mannequins or the like) may move into or out of cover or sightlines, or may be turned to suddenly face a shooter providing a reveal and hide scenario where shooting speed and correct reaction to a particular presentation can be just as important as shooting accuracy.

While these houses can provide for valuable simulations, they often have a similar problem. In order to provide the pneumatic controllers necessary to allow the paper targets to move or rotate, the targets can only be placed in a limited number of possible locations which are built into the structure and these locations can rapidly be learned by a trainee having gone through the shooting house a couple of times. This can give the shooter an unintended edge in the scenario which harms their ability to learn from their performance and to be accurately graded on their performance. Further, while some of these systems can also be used to provide some dynamics to a shooting range (for example by providing turning targets), because of the limitations of traditional shooting range infrastructure, movement is still generally heavily constrained and is generally limited to only a single turn or pop up motion with static characteristics, or a fixed linear motion which is also readily learned.

Another problem with traditional systems regardless of position is that they are often highly limited in their movement positions. For example, for rotating targets, there are generally only two positions, edge on (or hidden) and face on (or target). While some targets can present targets which are to be shot, and other targets which are not to be shot at to be to improve the scenario (e.g. four targets may simultaneously turn and two are to be shot at while two are to be avoided), once the target has been revealed, the shooter can then move on, and there is no possibility of the target changing. This is exacerbated because the targets often operate on a hard wired pattern where they rotate or move according to a fixed scenario regardless of the position of the shooter, or anyone else, in the scenario.

SUMMARY

The following is a summary of the invention which should provide to the reader a basic understanding of some aspects of the invention. This summary is not intended to identify critical components of the invention, nor in any way to delineate the scope of the invention. The sole purpose of this summary is to present in simplified language some aspects of the invention as a prelude to the more detailed description presented below.

Because of these and other problems in the art described herein, among other things, is a target system and methods related to using and manufacturing a target system. The target system is designed to be stand-alone and modular which includes a target area which is two or more sided and which can be rotated through a large number of different positions and rotations. The system can also include systems for projectile impact recognition. Target rotation is generally accomplished through a target base that is in communication with and configured to receive data input from a remote target controller and/or other target bases.

There is described herein, in various embodiments, a target system comprising: a target having at least two images thereon; and a target base station supporting said target and configured to receive data inputs from a target controller; wherein said target controller sends commands to said target base station to rotate said target through a plurality of different positions wherein a first of said plurality of positions presents a first of said at least two images and a second of said plurality of positions presents a second of said at least two images.

In an embodiment of the target system, the target comprises a target having exactly two images thereon.

In an embodiment of the target system, a third of said plurality of positions presents an edge view of said target which presents neither of said exactly two images.

In an embodiment of the target system, the target is a paper target.

In an embodiment of the target system, the target base station is one of a plurality of target base stations in communication with each other.

In an embodiment of the target system, the plurality of target base stations create an ad hoc network for said communication.

In an embodiment of the target system, the plurality of target base stations all utilize said target controller for said communication.

In an embodiment of the target system, the base station is positioned above said target.

In an embodiment of the target system, the base station is positioned below said target.

In an embodiment, the target system further comprising a stand for supporting said target base station and said target.

In an embodiment of the target system, the stand is repeatedly collapsible and constructible.

In an embodiment, the target system further includes a system to detect when said target is impacted by a projectile.

In an embodiment of the target system, the target is a target for a firearm.

There is also described herein a method of presenting a target to a user comprising: providing a target having at least two images thereon; providing a target base station supporting said target; said base station positioning said target in a first position where none of said at least two images is visible to a user; said base station positioning said target in a second position where a first of said at least two images is visible to a user; and said base station positioning said target in a third position where a second of said at least two images is visible to a user; wherein said first position, said second position, and said third position can be provided in any order or pattern.

DESCRIPTION OF THE PREFERRED EMBODIMENT(S)

Figure 1:
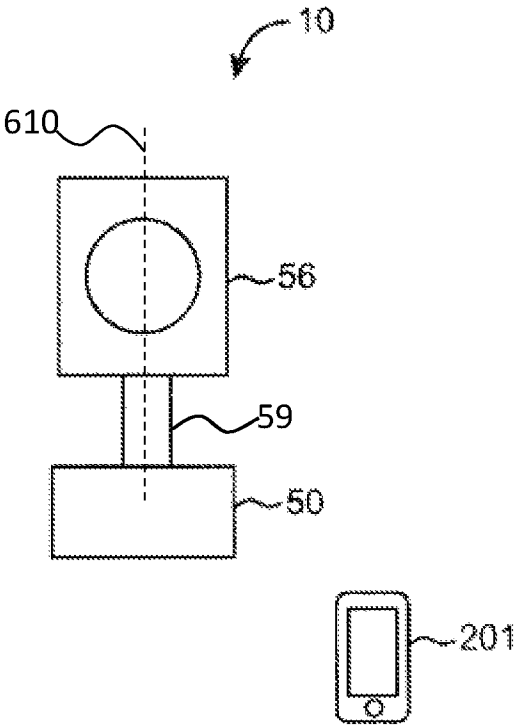
FIG. 1 is a general block diagram of an embodiment of a target system.

FIG. 1 provides a block view of the major components of an embodiment of the target system (10) preferably having a target (56), a target base station (50), and a remote target controller (201). The target (56) in the FIG. 1 embodiment is preferably in mechanical communication (59) with the target base station (50) so the base station (50) can provide it with rotational movement along at least one axis (610). The target base station (50) is preferably in electronic communication with the target controller (201) which can provide the base station (50) with instructions on how to move the target (56). The target (56) in the FIG. 1 embodiment is utilized for projectile impact recognition as well as to present an image indicative to a user of whether or not they should fire on it. As such, it may comprise a paper or similar material target which shows visible penetration when struck by a projectile, it may be a metal structure designed to provide sonic recognition when struck by a projectile, it may comprise a composite or similar material that will stop and hold a projectile to determine impact point, or it may comprise a more sophisticated structure which can otherwise determine that and projectile has impacted the target (56) surface, and where it has impacted it. Generally, the target (50) will provide a "bull's-eye" or similar structure where hitting the target in certain points is considered better than hitting it on others. The target base station (50) is preferably able to withstand projectile impact from a plurality of projectiles including a bullet shot from a firearm but this is not required and the base station (50) may simply be manufactured inexpensively and if hit, may simply be replaced. The target (56) will often be designed for use in a single shooting session and, as such, can be considered disposable.

Figure 2:
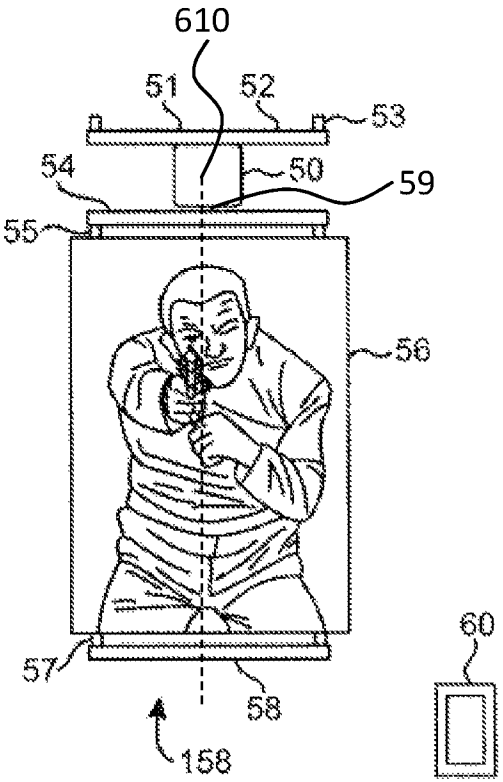
FIG. 2 is a front view of an embodiment of a target system displaying a target in firing position.

In most cases, the target (56) will be comprised of a paper or similar material target (56) which is held in place by a partial or full frame (158) as shown in FIG. 2. The fame (158) has a top bar (54) that has one or more connectors (55) holding the target (56) and that is rotatably secured to the target base station (50) through the connection (59). The fame (158) may also include connectors (57) at the bottom of the target (56) and a bottom bar (58). A target base station (50) is then connected to the frame (158) and the target base station (50) is mounted to a support structure. In the depicted embodiment, the base station (50) is connected to a rod (52) which can be positioned in a traditional indoor or outdoor/shooting range or may be hard mounted into a shooting house or similar dynamic shooting area, or may be part of a traditional rail system. The base station (50) will generally include connector devices (51) in the form of a bracket or similar device which can attach to a variety of objects to provide flexibility of attachment. This can allow the base station (50) to be attached at a variety of locations such as, but not limited to, tree branches, fences, wires, door frames, or locations within a shooting house or range. It can also allow the base station (50) to simply be attached to a heavy object to support it with the frame (158) held in a generally vertical position. Further, while the embodiment of FIG. 2 depicts that the frame (158) is hanging below the base station (50), this is by no means required and the base station may be positioned below the frame (158) or beside it to provide a perpendicular axis of rotation (610) to that depicted in FIG. 2. It may also be arranged at an angle between the above to provide further options. In a still further embodiment, the rotation could also allow for the target (56) to "pop-up" where it is originally positioned with the top or bottom facing the user (as opposed to a side) in the home position, and the target (56) will rotate upward or downward (instead of side to side) to present an image to the user.

The target base station (50) is preferably a modular unit that can be positioned in a variety of positions. The base station (50) may be used with a plurality of similar base station (50) to provide for a modular or multi-user range, or to provide multiple targets for a single shooter as contemplated below. While it will generally be the case that the base station (50) or support to which it is attached will include a self-leveling device, or level indicator to provide for it to be level to inhibit an uneven amount of torque to be provided to the frame (158), this is not required.

Figure 3:
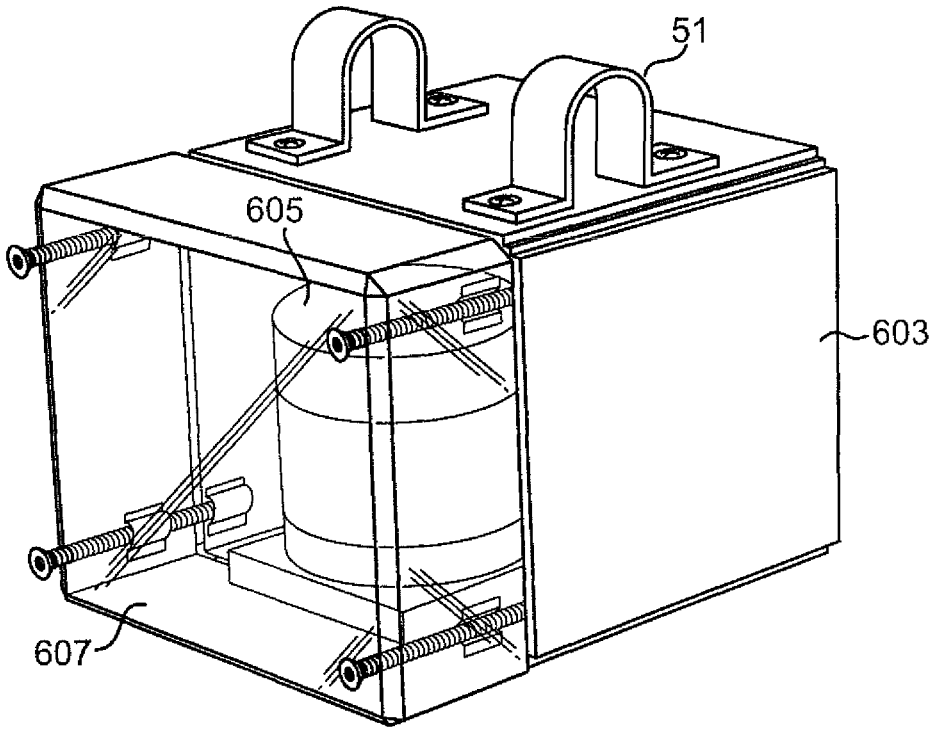
FIG. 3 provides a perspective view of the base station of FIG. 2
Figure 4:
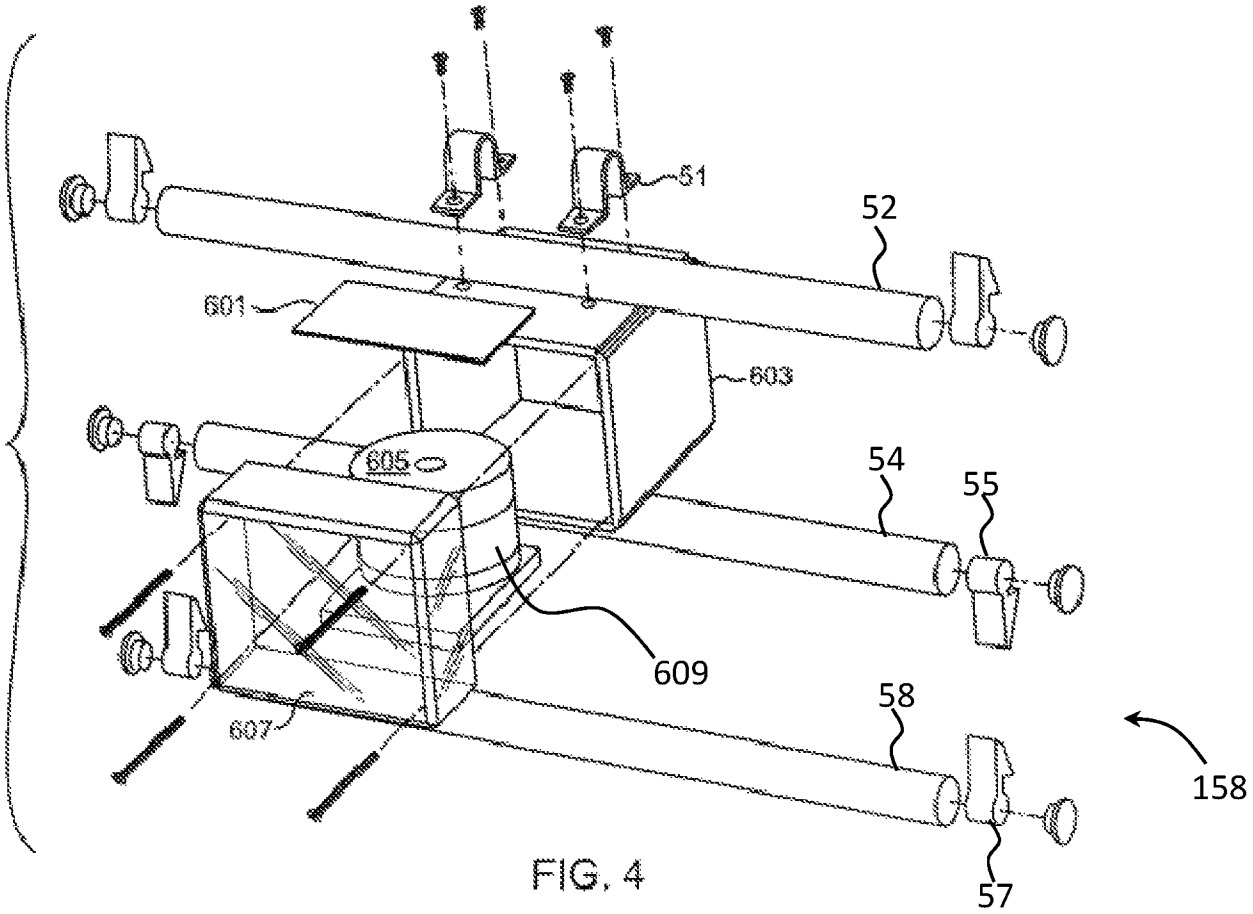
FIG. 4 is an exploded view of the base station of FIG. 3.

FIGS. 3 and 4 respectively provide assembled and exploded views of an embodiment of a base station (50). The target base station (50) will generally include an electric or similar motor (605) (in the depicted embodiment, it is an electronic stepper motor) that allows it to adjust the shooting target (56). Adjustment occurs by having the frame (158) that supports the shooting target (56) be moved by the motor (605) in the base station (50). This movement will generally be rotational and will allow the target (56) to move through a variety of positions and rotations, but it may also allow for linear movement both toward and away from the shooter or generally parallel to the shooter.

Figure 6:
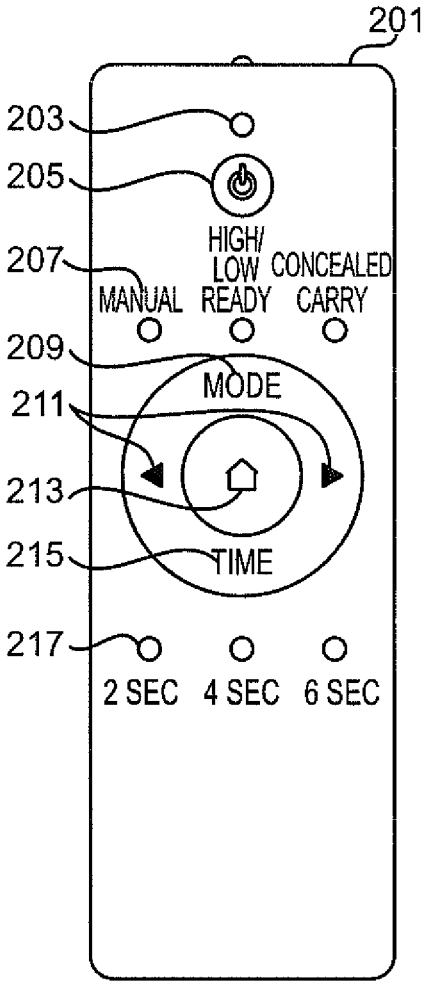
FIG. 6 shows an embodiment of a remote control system.

The base station (50) may include a variety of other components to provide for functionality and will often include a circuit board or similar computer controller (601) which can send and receive signals from a wireless controller (201), such as that shown in FIG. 6, can serve to activate the motor (605) in accordance with proposed movement demands, and which can interpret impacts if that functionality is provided. The motor (605) and computer controller (601) will generally be positioned within a housing (603) to inhibit damage to the components.

In an embodiment at least the front face (607) of the housing (603) may be designed to survive bullet or other projectile impacts to inhibit the likelihood of damage to the mechanisms of the base station (50) if the user misses the target (56) and hits the base station (50). The housing (603) may include appropriate power systems to power the motor (605) and computer control (601). The power system will often be some form of portable self-contained electric system such as a battery (609) or generator, but may include other systems known to those of ordinary skill in the art such as plugged in systems and hydraulic or pneumatic systems.

Figure 5:
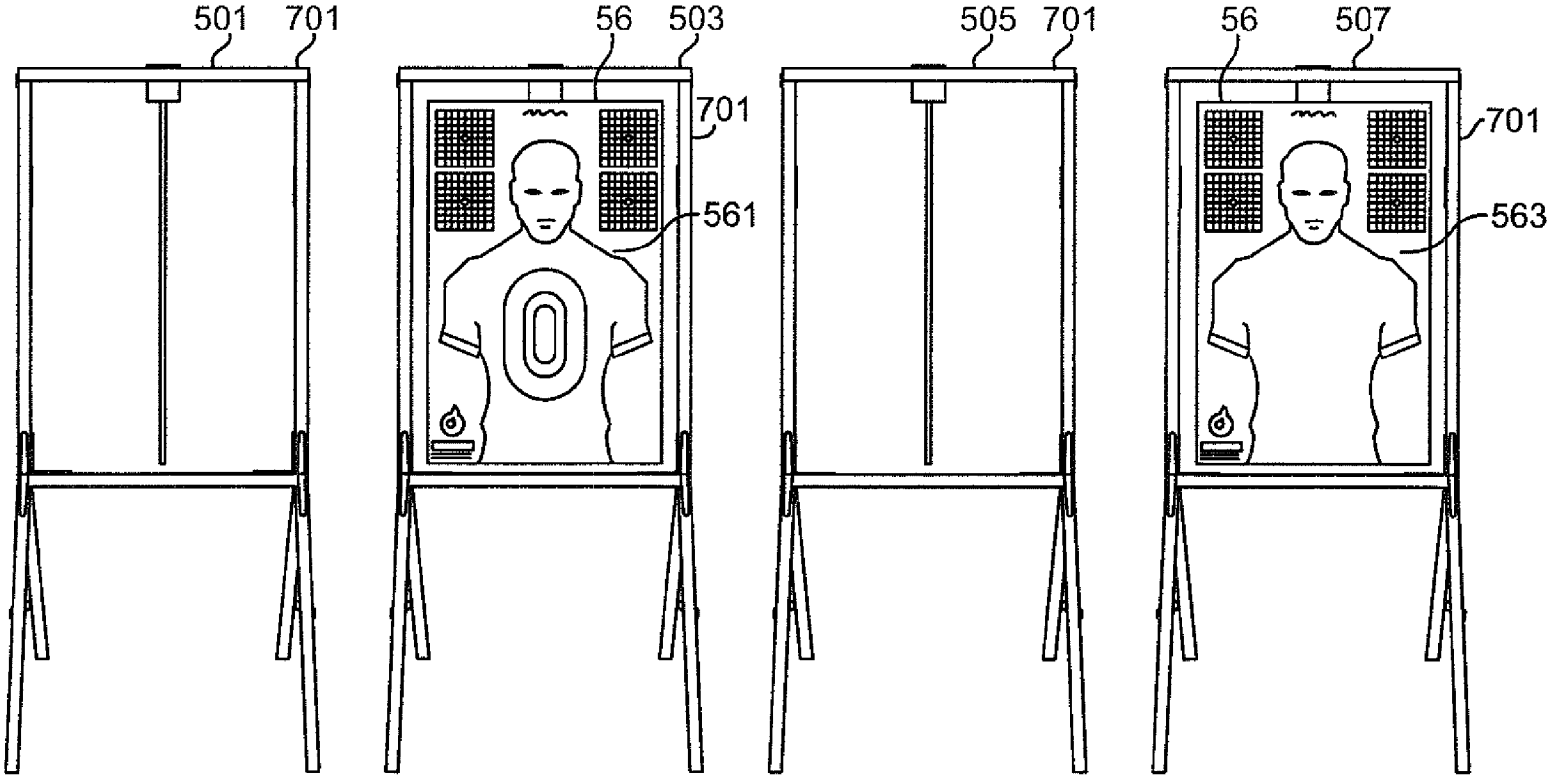
FIG. 5 shows an embodiment of a procession of target movement from a home (side) view, to a threat view, return to a home view, and to a no-threat view.

As can be best seen in FIG. 5, the target (56) in an embodiment is designed to be generally planar and to have two imaged sides. A first side (561) of the target (56) will generally be a "threat" side and will have a target presentation which is designed to indicate that a shooter should shoot the target when that side is presented. The "threat" image will often provide some kind of indicator representative of a threat which is recognized by the user as a threat indicator. For example, the image may be presented in a particularly aggressive color (such as red) or may provide an image of an individual holding a handgun or similarly dangerous item in a threatening position. The second opposing side (563) of the target (56) will generally include a "non-threat" image. This will be different from the "threat" image and may present a more neutral or passive color (such as green) or may provide an image of an individual holding a cell phone instead of a handgun. In the depicted embodiment the first side (561) of the target shows a human silhouette with a target on it while the send side (563) shows a silhouette with no target present.

It should be recognized that depending on the type of scenario the target (56) is for use in, and the type of shooting occurring, the target image may or may not be something which is printed or depicts a particular item. For example, on a sniper target (56) the image may simply be a color of the entire surface of the target. Similarly, the non-threat "image" may be that there actually is no image visible. That is, the target surface is blank (e.g. solid white or black) while the threat image actually depicts a threat such as an individual holding a handgun.

As should be apparent, in order to provide flexibility to the target system, targets (56) will generally be provided with both a threat and a non-threat image side. However, in some embodiments, targets (56) may be provided which include two threat or two non-threat images. This can provide for greater flexibility to the system (10) and to help defeat any involuntary detection that the image is likely a threat or non-threat without the shooter active cognitively processing the actual image. Similarly, targets (56) may be provided with a variety of different threat and non-threat images as part of a modular target package to provide for both flexibility and variation for the shooter.

In operation, the base station (50) can serve to rotate the target (56) into what are generally four different positions (501), (503), (505) and (507) as is illustrated in FIG. 5. These positions generally correspond to the four "sides" of the target (56). As should be recognized, because most targets (56) are generally planar objects with very little width (being a sheet of paper or metal) two of these "sides" actually correspond to the edges (side or top or bottom) of the target (56). As should be apparent, these positions present no target which is intended to be shot (and which all but a particularly skilled marksman would certainly miss). Thus, should the shooter see a target (56) in these "side-on" positions (which may be referred to as the "home" position (501) or (503)) they are not really presented with a target to shoot at.

From the home position, the base station (50) will generally cause the target (56) to rotate to present a different side of the target (56) to trigger a shooter reaction. If this rotation is to position (503), this is the threat image (561) and the user is expected to shoot at the target. Alternatively, it this is position (507), the non-threat image (563) is shown and the shooter is expected to hold their fire. The key here is that the home position will generally be used as a starting point or rest position, however that is not necessary and the home position can be used as a decision position itself. This is particularly true when multiple base stations operate together as part of the scenario.

In order to provide for a valuable training simulation, as well as a potentially entertaining shooting environment, the base station (50) will generally be capable of providing the target in either of its image positions (503) and (507) for a certain limited period of time. This time can correspond to, for example, the expected amount of time it would take an enemy to raise their own weapon and pull the trigger, or for them to cross a hallway or other visibility point. However any length of time may be used and the time of presentation may be set by the remote control (201) as indicated later. After the presentation of the particular time has been made, the base station (50) will rotate the target to a different position. This may be a home position (501) or (505), or another presentation position (503) or (507).

The present base station (50), because it primarily uses an electronic motor (605) and does not require connection to a control infrastructure for pneumatic power, can provide for a number of rotational effects beyond those provided by traditional pneumatic systems. In the first instance, the target (56) can rotate to or from any position (501), (503), (505), or (507) in either direction, simply by reversing the power inflow into the motor (605). This means that a shooter cannot effectively guess the face to be presented to them by seeing the target (56) rotate a previous time. Similarly, the motor (605) also need not carry out a single 90 degree rotation between a face and one specific home, forward and back. When the target (65) is rotated it may rotate 90 degrees, 180 degrees, 270 degrees, 360 degrees, or more in either direction, this means that a shooter can be presented with any image, from rotation in any direction, from any starting point. This can allow the home position (501) to rotate to home position (505) to effectively provides for an additional "hold-fire" position. It can also allow a non-threat presentation (507) to immediately rotate to a threat presentation (503).

As should be apparent, while the present embodiment contemplates a generally planar target (56) with two image faces (562) and (563) and two "presented" side edges, this is by no means required. In more sophisticated embodiments, the target frame (158) may be designed to support a greater number or shape of targets (56). For example, four single sided targets may be presented in a square arrangement so that each position (501), (503), (505), or (507) brings a new image. Also, a target may be presented with any of its six sides visible, or even partially obscured (e.g. at an angle other than perpendicular to the user) to provide for further functionality.

In an embodiment, multiple base stations (50) may be electronically linked together to provide for multiple targets (56) which operate in conjunction and coordination with each other. For example, a number of targets (56) may be positioned side by side which each move in accordance with the position of another target (56) in the arrangement. Alternatively, the targets (56) may be presented serially (one behind the other). This latter option can provide for a particularly interesting challenge as a shooter may need to make an assessment when presented with a threat face (561) at a farther target if they should take the shot knowing a nearer target may rotate to a non-threat face (563) where they are supposed to hold fire. This reaction and determination has to be made before they pull the trigger and if they choose to shoot, the closer target may block their view of the more distant target at any time. This can provide for the shooter to need to react not just by shooting the threat target, but by moving as part of the engagement to clear their line of sight to the further target.

Communication between base stations (50) may be provided by any communication protocol known now or later discovered including, but not limited to, Bluetooth™ Wi-Fi, or other wireless or wired connections. Generally, the communication will occur wirelessly to aid in the modularity of the system (10) and the communication infrastructure and instructions will be included on the computer control (601). Coordinated control may be done using an ad hoc network formed of base stations (50) and programs (such as those that may be stored in an internal memory on the computer controller (601)), or may be through a centralized control, such as the remote controller (201).

Because the system (10) is designed to provide for both shoot and hold-fire positions, in an embodiment, it can also be desired for the system to be able to determine if the user acted correctly in the correct circumstance. While a shooter will generally know as each target (56) is presented if they reacted correctly, without an observer or other objective measure of success, they may not be able to keep the score of their performance over an entire shooting house or range correctly. This can be particularly true if the base stations (50) are designed to present the faces (561) and (563) randomly, so there is no record of which facing was presented when the shooter was in any particular location. In a scenario where a user is likely highly focused on their performance at each individual target (as they should be in a shooting house type of arrangement), this means that accurate score keeping can be very difficult. Further, with a two sided paper target, it will often be difficult to determine from which side a bullet impacted the target although this can sometimes be used as a default. However, if the target may present multiple faces during the shooting activity, this may also be an untenable scorekeeping method.

To aid in scorekeeping, the base station (50) can, in an embodiment, include an impact recognition system. In an embodiment, projectile impact recognition occurs when a projectile impacts the target (56) and an electrical signal is sent to the target base station (50). This may be, for example, by the bullet breaking a wire in the target (56) or otherwise altering properties of the target (56) so its position can be detected. If may also be by the base station including audio systems that detect the percussion sound of the firearm discharging and whether the bullet simply hit the target (56) at all. The target base station (50) preferably responds by either storing scoring information for later retrieval or by processing the score as an electrical signal and sending the impact data to the target controller (501) using the same connection from which it receives instructions. From the target controller (501), information from the impact data may recorded or displayed at any time during or after the shooting scenario.

While a target controller (201) is not necessary and control of target (56) rotation and impact detection, if present, may be performed entirely at the base station (50), it is generally preferred that a remote controller (201) be provided. The target controller (201) is preferably used to send commands to the target base station (50) that control the target (56) adjustments. The target (56) adjustments can include positional and pace adjustments in the process of a shooting cycle to challenge the shooter as well as allowing for setting of various features of the shooting. The controller (201) may be provided as a dedicated remote control as shown in FIG. 12, or may be provided as a software or similar application (for example, an "app") which may be run on a shooter's or other user's smartphone or network connected computer device. The former is generally preferred for security and safety reasons, but is not required and the later can reduce hardware costs in a commercial system.

FIG. 6 provides an embodiment of a remote control (201) and gives some indication of some of the options for control over the target (56) that can be provided. In the embodiment of FIG. 6, the remote control (201) includes general power controls (205) and an associated power indicator light (203).

It can also include a mode selector (209) and associated indicators. In the depicted embodiment, the modes can correspond to a manual control mode which would commonly be used if someone other than the shooter is operating the remote control (201) as this will allow them to alter the presentation in accordance with their own pattern, or modes such as concealed carry and high/low ready to provide particular arrangements and patterns useful in particular training scenarios.

There can also be manual control buttons on the remote control (201) such as left and right rotation (211) and home (213) which will cause the connected base station or stations (50) to select particular positions and rotation in manual control. As should be apparent, hitting a button repeatedly, could cause multiple rotations or shifts consecutively. Similarly, the user may manually select a time mode (215) which will provide for how long a particular position is maintained without other user input, or how difficult (e.g. fast) a particular prepared mode may run. This selected time will generally also be indicated on an indicator (217).

As has been indicated previously, the base station (50) can provide target range modularity with the ability to centrally (or ad hoc) control a number of base stations (50) in conjunction with other bases stations (50) to provide for coordinated shooting activities. Further, the base station (50) can positioned virtually anywhere to provide very flexible arrangements. While the system (10) will often be used in conjunction with prepared infrastructure (such as a shooting house or range), this is not necessary with the system (10) and, in an embodiment, the system (10) does not need any form of infrastructure to be used.

In this arrangement, the system (10) can be setup to provide for a live fire range anywhere it is safe to do so. For example, the range can be setup in a relatively open field, in an arena with moveable obstacles and barriers, or even in a city or town where there are no potential dangers from people wandering into the range. To provide for this type of arrangement, the base station (50) may be provided with a prepared stand (701) which can be positioned as desired or base stations (50) may simply be positioned on available infrastructure. This allows the base station (50) to not only be used in specific shooting houses and shooting ranges, but anywhere ammunition may be expended safely.

Figure 7A:
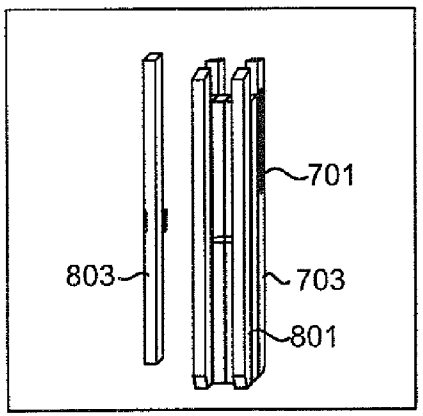
FIGS. 7A, 7B, 7C, 7D, 7E, and 7F show assembly steps of a collapsible stand useable with the target system of FIG. 2.

In a particular embodiment, the stand (701) is a standalone unit which is comprised of a frame (703) which is constructed from common lumber materials or synthetic equivalents such as plastics. In some instances the frame (703) is constructed from two by four wood. FIGS. 7A-7F provides an embodiment of a repeatedly constructible and collapsible stand (701) which can be used with a base station (50). As can be seen in the montage images of FIG. 7A-7F, the stand (701) can be easily transported to any location in a folded fashion (FIG. 7A), set up (FIGS. 7B-7E), and the base station (50) can then be attached to the top or bottom of the main opening (705) of the stand (701) in the finalized assembly (FIG. 7F). As can be seen in FIGS. 7A-7F, in an embodiment the entire frame is easily compacted for travel employing various hinges and fasteners and only two pieces, as shown in FIG. 7A, to be easily hand help for transportation.

Figure 7B:
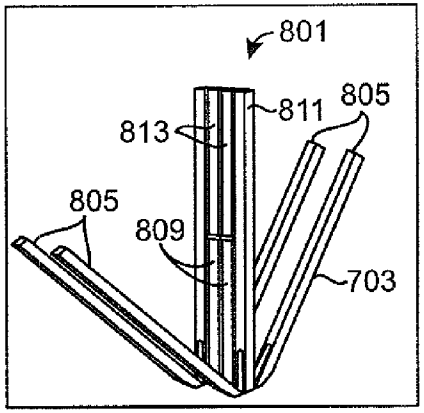
Figure 7C:
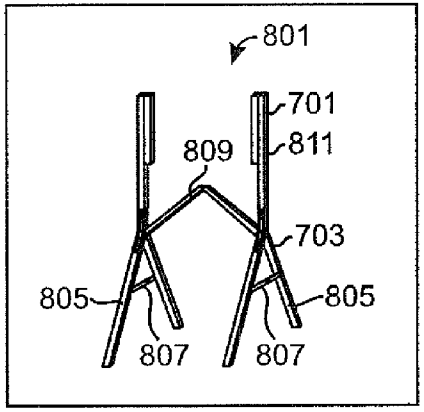
Figure 7D:
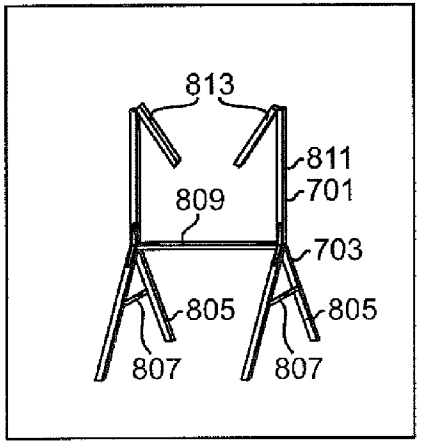
Figure 7E:
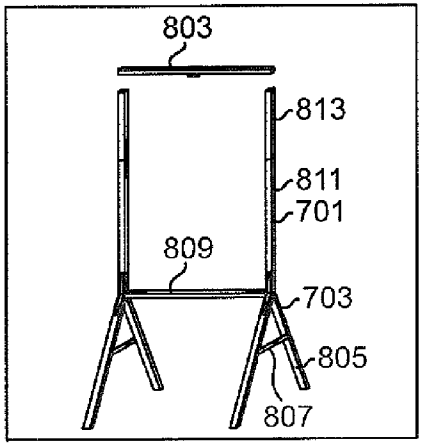
Figure 7F:
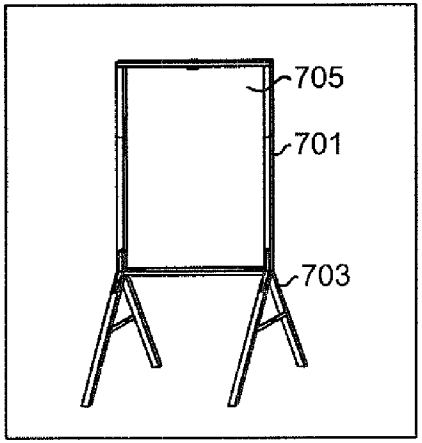

Generally, assembly of the stand (701) will occur by first removing the components (801) and (803) from a storage bag or connector (FIG. 7A), the legs (805) can then be folded down into an inverted "Y" position (FIG. 7B). Once positioned, the legs are braced (807) and moved apart to form the lower cross beam (809) (FIG. 7C). The uprights (811) then extend to their full height via rotation of top portions thereof (813) (FIG. 7D). Finally, the top cross bar (803) is added to the uprights (811) (FIG. 7E) and the stand (701) is fully assembled (FIG. 7F).

While the general assumption for the turning target system (10) is that it will be used for firearm training and entertainment purposes, this is by no means required. The target and unit can be designed to operate with any projectile weapon or device including non-lethal devices such as, but not limited to, Taser systems and paintball guns. Similarly, it can be used without the inclusion of a projectile weapon or device. For example, it can be presented as part of a simple escape scenario where a user is unarmed, but needs to make decisions about who to move toward or away from when running in a building. The modular rotation can also be useful for other types of training. For example, the rotation can be used to provide images indicative of different types of baseball pitches to allow a batter to swing in reaction to what he sees. Similarly, the target may present images of different parries to allow practice of fencing or other blade fighting lunges depending on the nature of the guard presented.

Still further, while the above primarily contemplates motion of the target (56) from rotation along a vertical axis, this is by no means required and the rotation may be along any axis. Further, multiple axes of rotation can be used in particularly sophisticated base stations (50) including multiple motors and control can be provide and multiple base stations (50) can even be connected to the same target (56) to provide for certain additional types of motion. This can allow for targets (56) to be moved from any presentation to any other including angled and partial cover presentations. Rotational movement from the base station (50) may also be coupled with linear movements by connecting the base station (50) to linear movement systems.

While the invention has been disclosed in connection with certain preferred embodiments, this should not be taken as a limitation to all of the provided details. Modifications and variations of the described embodiments may be made without departing from the spirit and scope of the invention, and other embodiments should be understood to be encompassed in the present disclosure as would be understood by those of ordinary skill in the art. Accordingly, it is intended that all reasonably foreseeable addition, modifications, deletions and alterations be included within the scope of the invention as defined in the following claims.

The invention claimed is:

1. A target system for a target having a front face, a back face, and a pair of side edges, comprising:

a target frame configured to hold the target, wherein the target is suspended from said target frame;

a target support, wherein said target support is a target stand comprised of a top cross bar, a pair of side bars, and a base;

a bracket, wherein said bracket is connected to said top cross bar between said pair of side edges of said target, wherein said top cross bar, said pair of side bars, and said base have a collapsed configuration and an assembled configuration, wherein said collapsed configuration is compacted, wherein said assembled configuration is extended to form a main opening;

a target controller; and a target base station suspended from said target support and configured to receive data inputs from said target controller; wherein said target base station is comprised of a housing, a motor, and a computer controller, wherein said motor and said computer controller are located within an interior of said housing, wherein said bracket connects said housing to said target support above said target frame, wherein said motor is connected to and rotates said target frame, wherein said target controller sends commands to said target base station to rotate said target held by said target frame through a plurality of different positions, wherein a first of said plurality of positions presents the front face of the target and a second of said plurality of positions presents at least one of the back face and one of the pair of side edges, wherein said target base station is further comprised of a bullet resistant front face, wherein said housing is suspended from said top cross bar by said bracket within said main opening in said assembled configuration, and wherein said target frame is positioned below said housing and said motor within said opening.

2. The target system of claim 1 wherein said target base station is one of a plurality of target base stations in communication with each other.

3. The target system of claim 2 wherein said plurality of target base stations create an ad hoc network for said communication.

4. The target system of claim 2 wherein said plurality of target base stations all utilize said target controller for said communication.

5. The target system of claim 1 wherein said target support is repeatedly collapsible and constructible, wherein said motors rotates said target frame around a rotation axis, and wherein said rotation axis extends through said motor.

6. The target system of claim 1 further including a system to detect when said target is impacted by a projectile.

7. The target system of claim 1 wherein said target base station is further comprised of a battery held within said interior of said housing, and wherein said battery powers said motor and said computer controller.

8. A target system for mounting to a support, comprising: a housing comprised of a front side, a back side, a mounting side, a rotating side, an interior, and an exterior, wherein the housing is further comprised of a motor and a computer controller, wherein the connector has a rotation axis, wherein the motor and the computer controller are held within the interior of the housing, wherein the motor rotates the connector about the rotation axis on the rotating side of the housing between a plurality of positions, and wherein the computer controller communicates with and controls the motor; a bracket, wherein the bracket is connected to the exterior of the mounting side of the housing; a target frame attached to the connector on the rotating side of the housing; a bullet resistant face positioned on the exterior of the front side of the housing, wherein the bullet resistant face is connected to the front side of the housing; a remote controller, wherein the remote controller wirelessly communicates with and controls the computer controller; and a stand, wherein the stand is comprised of a top cross bar, a pair of side bars connected to opposite ends of said top cross bar and extending downward from the top cross bar, and a base connected to bottom ends of the pair of side bars, wherein the bracket is connected to the top cross bar between the pair of side bars, wherein the housing is suspended from the top cross bar by the bracket, and wherein the target frame is suspended from the connector below the rotating side of the housing.

9. The target system of claim 8, wherein the target frame is at least one of a full target frame and a partial target frame.

10. The target system of claim 8, wherein the base is further comprised of a pair of legs, a lower cross beam, and a plurality of fasteners, wherein the top cross bar, lower cross beam, and pair of side bars have a collapsed configuration and an assembled configuration, wherein said collapsed configuration is compacted, wherein said assembled configuration is extended to form a main opening, wherein said fasteners connect said top cross bar, said pair of side bars, said lower cross beam, and said pair of legs, and wherein the housing is positioned within the main opening in the assembled configuration.

11. A target system for mounting to a support, comprising: a housing comprised of a front side, a back side, a top mounting side, a bottom rotating side, an interior, and an exterior, wherein the housing is further comprised of a motor and a computer controller, wherein the connector has a rotation axis, wherein the motor and the computer controller are held within the interior of the housing, wherein the motor rotates the connector about the rotation axis on the bottom rotating side of the housing between a plurality of positions, wherein the rotation axis extends through the motor, and wherein the computer controller communicates with and controls the motor; a bracket connected to the top mounting side of the housing; a target frame suspended from the connector on the bottom rotating side of the housing; a bullet resistant face positioned on the exterior of the front side of the housing, wherein the bullet resistant face is connected to the front side of the housing; a remote controller, wherein the remote controller wirelessly communicates with and controls the computer controller; and a rod connecting the exterior of the top mounting side of the housing to the support, wherein the housing is connected to and suspended from the rod by the bracket.

12. The target system of claim 11, wherein the rotation axis extends through the target frame.

13. The target system of claim 8, wherein a target is removably connected to the target frame, wherein the target is comprised of a top edge, a bottom edge, a pair of side edges, a first face and a second face.

14. The target system of claim 13, wherein the plurality of positions are comprised of a presented position and a plurality of non-presented positions, wherein in a first position the first face is in the presented position and the second face is in the non-presented position, wherein in a second position the second face is in the presented position and the first face is in the non-presented position, and wherein in a third position one of the pair of the target side edges is in the presented position and the opposite side edge, the first face, and the second face are in the non-presented positions.

15. The target system of claim 8, further comprising a battery held within the interior of the housing, and wherein the battery powers the motor and the computer controller.

16. The target system of claim 11, wherein the housing is further comprised of a battery held within the interior of the housing, and wherein the battery powers at least one of the motor and the computer controller.

17. The target system of claim 11, wherein the support is further comprised of a target stand, wherein the target stand is comprised of a base and at least one side bar connected to and extending from the base, wherein the rod is connected to the side bar and extends to the exterior of the mounting side of the housing, and wherein the bracket extends from the exterior of the mounting side of the housing and mounts to the rod.

18. The target system of claim 17, further comprising a second side bar connected to and extending from the base opposite from the one side bar, wherein the rod extends between and connects the one side bar to the second side bar as a top cross bar, wherein the rod, the one side bar, the second side bar, and the base have a collapsed configuration and an assembled configuration, wherein the collapsed configuration is compacted, wherein the assembled configuration is extended to form a main opening, and wherein the housing is suspended by the bracket within the main opening in the assembled configuration.

19. The target system of claim 18, further comprising a target, wherein the target is removably connected to the target frame, and wherein the target is comprised of a top edge, a bottom edge, a pair of side edges, a first face and a second face.

20. The target system of claim 19, wherein the plurality of positions are comprised of a presented position and a plurality of non-presented positions, wherein in a first position the first face is in the presented position and the second face is in the non-presented position, wherein in a second position the second face is in the presented position and the first face is in the non-presented position, and wherein in a third position one of the pair of the target side edges is in the presented position and the opposite side edge, the first face, and the second face are in the non-presented positions.

* * * * *